United States Patent [19]

Fyson et al.

[11] 4,293,638

[45] Oct. 6, 1981

[54] METHOD FOR ALLEVIATING PARTIAL INACTIVATION OF COLOR COUPLERS

[75] Inventors: John R. Fyson, London; Gerald I. P. Levenson, Harrow, both of England

[73] Assignee: Eastman Kodak Company, Rochester, N.Y.

[21] Appl. No.: 153,504

[22] Filed: May 27, 1980

[30] Foreign Application Priority Data

May 30, 1979 [GB] United Kingdom ..... 18821/79

[51] Int. Cl.[3] ..... G03C 7/00

[52] U.S. Cl. ..... 430/373; 430/386; 430/429; 430/432; 430/943

[58] Field of Search ..... 430/373, 429, 432, 943, 430/963, 386

[56] References Cited

U.S. PATENT DOCUMENTS 2,623,822 12/1952 Duerr ..... 430/430
3,189,452 6/1965 Bard et al. ..... 430/430
3,841,873 10/1974 Mowrey et al. ..... 430/373
3,846,130 11/1974 Purol et al. ..... 430/373
4,094,682 6/1978 Fujiwhara et al. ..... 430/943

FOREIGN PATENT DOCUMENTS 843940 8/1960 United Kingdom .

*Primary Examiner*—J. Travis Brown
*Attorney, Agent, or Firm*—D. F. Janci

[57] ABSTRACT

A method is disclosed for alleviating the partial inactivation of color couplers caused by adventitious reaction with vapors of formaldehyde or a vinyl monomer. Partial inactivation is evidenced by decreased spectral absorptivity of the dye produced by reaction of the color coupler with color dye-forming compounds, such as oxidized photographic color developing agents. The method comprises contacting a partially inactivated coupler with an aqueous solution comprising an oxidizing agent and an oxidation accelerator.

17 Claims, No Drawings

METHOD FOR ALLEVIATING PARTIAL INACTIVATION OF COLOR COUPLERS

BACKGROUND OF THE INVENTION

1. Field of the Invention

This invention relates to the formation of color dyes by the reaction of color couplers with other dye-forming compounds and especially relates to the imagewise formation of color dyes in a photographic element. More particularly, the invention is concerned with alleviating the problem of partial inactivation of color couplers caused by adventitious reaction of the couplers with formaldehyde or a vinyl monomer such as styrene.

2. Description Relative to the Prior Art

It is well known to use silver halide photographic elements containing color couplers to form color photographic images by means of imagewise coupling reactions of the color couplers with oxidized primary aromatic amino color developing agents. The developing agents are oxidized by reaction with imagewise exposed silver halide.

Some of the color couplers incorporated in photographic elements are susceptible to total or partial inactivation caused by adventitious contact with vapors of formaldehyde or vinyl monomers between manufacture and processing of the elements. This sometimes occurs, for example, through contact of a photographic element with polluted air. This problem is well known in the photographic art, especially in relation to many pyrazolone color couplers which are used to form magenta dyes in photographic elements. Descriptions of pyrazolone color couplers can be found in many references along with descriptions of the preparation and use of photographic elements which contain such couplers. See, for example, U.S. Pat. Nos. 2,600,788; 2,772,161; 2,865,748; 2,933,391; 3,006,759; 3,062,653; 3,214,437; 3,253,924; 3,311,476; and 3,419,391 and the patents referenced therein, all of which are hereby incorporated herein by reference.

If a color coupler susceptible to this problem comes into contact with a large amount of formaldehyde, it can become totally inactivated; i.e., it will not couple at all with an oxidized primary aromatic amino color developing agent, and no dye will be formed during processing. However, it is more commonly the case that a photographic element will adventitiously come into contact with only smaller amounts of formaldehyde. When this occurs, color couplers susceptible to the problem may be only partially inactivated. Although the mechanism of partial inactivation is not well understood, it is known that a partially inactivated color coupler will still react with oxidized developing agent to form a dye, but the dye will exhibit a less-than-normal degree of spectral absorptivity. It is theorized that in such cases the reaction with formaldehyde has only partially inhibited the coupling reaction or has otherwise reacted with the color coupler to tie up color-forming sites and prevent full color formation when the coupler combines with oxidized developing agent to form a dye. Whatever the true explanation for this phenomenon, its effect is well known.

It is also known that the effect of partial inactivation can be substantially overcome if, after the photographic element is developed with a primary aromatic amino color developing agent, subjected to a development stop bath and then washed during processing, the element is treated with an aqueous bleaching solution comprising a very potent bleaching agent, such as potassium ferricyanide, which has a very strong oxidizing effect. Such a bleaching agent will overcome the partial inactivation of a color coupler by formaldehyde and cause the spectral absorptivity of the dye formed by reaction of the color coupler with oxidized developing agent to be increased.

However, in order to achieve compactness of processing apparatus and speed of photographic processing operations, it is desirable to omit baths such as stop baths and washing baths from between the color development and bleaching baths. In addition, while the bleaching bath (the main purpose of which is to oxidize silver image for easy removal) has in the past been followed by a separate fixing bath (to remove oxidized silver image and unexposed silver halide from the element), it is desirable and known to further increase compactness and speed by incorporating the bleaching agent and fixing agent into a single bleach-fix bath. These practices require that a mild oxidizing agent be used as the bleaching agent, because a strong oxidizing agent such as potassium ferricyanide would cause indiscriminate formation of dye in the element if stop and wash baths were omitted after development, and, if incorporated in the same solution with a fixing agent, a strong oxidizing agent would oxidize the fixing agent making it useless for its fixing function. To avoid these problems, it is desirable to use a mild oxidizing agent as the bleaching agent (e.g., a complexed form of ferric ion such as iron ammonium ethylenediaminetetraacetic acid). Unfortunately, such mild bleaches are incapable of overcoming the partial inactivation of color couplers by formaldehyde, and it has heretofore been thought that, in order to overcome such partial inactivation, further steps of re-bleaching with a potent oxidizer and then washing out the bleach would have to be used. However, this would once again slow the processing operation and require new, less compact processing apparatus, because of the additional baths which would have to be used; and, in addition, it would once again raise the environmental problems of disposing of noxious substances such as the ferricyanides.

Therefore, it is apparent that a need exists for a method of alleviating the partial inactivation of color couplers, which does not require increasing photographic processing time by adding new processing baths and which does not require that new, less compact processing apparatus be used in order to practice the method. The present invention provides a method which satisfies this need.

SUMMARY OF THE INVENTION

The invention provides a method for alleviating the partial inactivation of a color coupler caused by reaction of the coupler with formaldehyde or a vinyl monomer. The method comprises contacting the partially inactivated color coupler with an aqueous solution comprising an oxidizing agent and an oxidation accelerator in order to increase the spectral absorptivity of a dye formed by the reaction of the color coupler with another dye-forming compound such an oxidized primary aromatic amino color developing agent.

Generally, the color coupler is contacted with the aqueous solution used in this method after the coupler has already reacted with another dye-forming compound (such as an oxidized primary aromatic amino color developing agent) to form a dye having less-than-normal spectral absorptivity.

In regard to photographic elements, the invention provides a method for producing a dye image in an imagewise exposed photographic element containing a silver halide and a color coupler susceptible to partial inactivation by reaction with formaldehyde or a vinyl monomer. The method comprises the steps of:

a. contacting the element with a primary aromatic amino color developing agent to produce within the element a silver image and an associated dye image formed by reaction of the color coupler with oxidized color developing agent,
b. contacting the element with a bleaching agent and a fixing agent either simultaneously or successively in order to remove unexposed silver halide and the silver image from the element while retaining the dye image, and
c. contacting the element with an aqueous solution comprising an oxidizing agent and an oxidation accelerator in order to alleviate any partial inactivation of the color coupler which may have occurred.

Step c. above is preferably carried out by combining the described aqueous solution with a washing bath conventionally used after the fixing step or with a stabilizing bath conventionally used after the washing bath. In this way, the step in the process for alleviating partial inactivation of color coupler can be carried out simultaneously with other steps (e.g., washing or stabilization), and, therefore, will not require a longer processing time or the use of new or modified processing apparatus. Alternatively, the aqueous solution of step c. may be applied to the photographic element by a roller or other means, rather than in a processing bath. Also, no washing step is required after this treatment, in contrast to conventional ferricyanide re-bleaching techniques which do require such a wash.

It has been found that the method of the present invention will increase the spectral absorptivity of dyes formed by reaction of partially inactivated couplers with other dye-forming compounds to nearly the levels that can be achieved by using the previously known technique of separate ferricyanide re-bleaching followed by washing.

DETAILED DESCRIPTION OF THE PREFERRED EMBODIMENTS

As previously described, the method of the present invention for alleviating partial inactivation of a color coupler comprises contacting the color coupler with an aqueous solution comprising an oxidizing agent and an oxidation accelerator.

The oxidizing agent used in the aqueous solution is preferably one which can be applied to the color coupler without requiring the use of a further washing step to remove the oxidizing agent from the dye-containing material (e.g., photographic element). Thus, the oxidizing agent is preferably one which can remain in a photographic element without producing undesirable side effects or one which can be removed from the element without washing. A preferred oxidizing agent for use in the process of the invention is one which is volatile, so that it can be removed from a photographic element merely by drying at normal atmospheric conditions or in a heated drying cabinet (conventionally at temperatures of from about 24° C. to about 70° C.). Peroxides such as hydrogen peroxide or deuterium peroxide, are good examples of volatile oxidizing agents useful in this method. Hydrogen peroxide is a particularly preferred oxidizing agent for this method.

The concentration of oxidizing agent in the aqueous solution should be at a level effective to alleviate the partial inactivation of color coupler without producing undesirable side effects. If the concentration is too low, coupler inactivation may not be alleviated or may be alleviated to a lesser degree, while if the concentration is too high, dye decomposition may result. In a particularly preferred embodiment of the method of the invention, hydrogen peroxide is used as the oxidizing agent in the aqueous solution at a concentration of from about 0.3 percent to about 0.6 percent by weight of the total aqueous solution.

While an oxidizing agent such as hydrogen peroxide has very little effect by itself in alleviating partial inactivation of couplers, it has been unexpectedly found that the method of the invention produces a significant alleviating effect when the aqueous solution also comprises an oxidation accelerator to act as a catalyst for the oxidizing agent. Oxidation accelerators useful in the method of the invention are potential mediators capable of acting as electron-transfer agents between the oxidizing agent and an oxidizable substance by undergoing reversible oxidation-reduction without an appreciable degree of decomposition or degradation. Such compounds are known in the art of electrochemistry, where they are used to accelerate the equilibration of oxidation-reduction reactions.

In the method of the present invention, the oxidation accelerator preferably does not leave a residue that would strongly color a photographic element, nor does it adversely affect the stability of the dye formed by reaction of color coupler with other dye-forming compound. Therefore, the concentration of oxidation accelerator in the aqueous solution is preferably very low, i.e., the oxidation accelerator comprises less than 10 parts per million or less than 0.001 percent by weight of the aqueous solution. Examples of oxidation accelerators suitable for use in the method of this invention include but are not limited to potassium ferricyanide, sodium anthraquinonedisulfonate, and disodium iron ethylenediaminetetraacetic acid. Potassium ferricyanide is preferred.

In a particularly preferred embodiment of the method of the present invention, the aqueous solution comprises from about 0.3 percent to about 0.6 percent by weight of hydrogen peroxide as the oxidizing agent and from about 0.0001 percent to about 0.0003 percent by weight of potassium ferricyanide as the oxidation accelerator.

When the method of the invention is embodied in a process for producing a dye image in an imagewise exposed silver halide photographic element, the aqueous solution used to alleviate partial inactivation of couplers is advantageously combined (as previously mentioned) with one of the various processing baths which follow the developing, bleaching, and fixing baths in a conventional photographic color processing method. For example, in one embodiment, the aqueous solution of oxidizer and accelerator is incorporated into an aqueous washing bath which conventionally follows the fixing bath. In another embodiment it is incorporated into a stabilizing and/or wetting agent bath which follows the washing bath just mentioned. Alternatively, the aqueous solution is applied to the photographic element in a separate bath by itself or is applied by a roller or other means; but incorporation into an already existing bath is more desirable, because it avoids any lengthening of overall processing time and also avoids the need for any modifications to existing processing apparatus. A conventional stabilizing bath with which the aqueous solution of oxidizer and accelerator is combined comprises a stabilizing agent, such as formaldehyde, in water and sometimes also comprises a buffer system to maintain pH at a desired level. A conventional wetting bath (which is often combined with the stabilizing bath, but can be separate) contains a wetting agent, such as a non-ionic derivative of polyethylene glycol, in water. The composition and use of such stabilizing and wetting baths are well known in the photographic processing art. See, for example, U.S. Pat. No. 3,545,970 and Canadian Pat. No. 776,111.

The composition and use of conventional, developing, bleaching, and fixing baths preceding the above-described washing and stabilizing baths are also well known in the art of processing imagewise exposed silver halide photographic elements which contain incorporated color couplers. Conventionally, the exposed photographic element is first contacted with a primary aromatic amino color developing agent (e.g., N-ethyl-N'-hydroxyethyl-p-toluidine) to produce within the element a silver image and an associated dye image formed by reaction of incorporated color couplers with oxidized color developing agent. It is now conventional to omit subsequent stop and wash baths and, instead, move the developed photographic element next into a bleaching bath comprising a mild bleaching agent, such as iron ammonium ethylenediaminetetraacetic acid, which is incapable of overcoming possible partial inactivation of color couplers by formaldehyde or vinyl monomers. The bleaching bath is followed by a wash and a fixing bath (or is combined with a fixing bath) containing a fixing agent (e.g., ammonium thiosulfate). The purpose of the bleaching and fixing baths is to remove the silver image and any unexposed silver halide from the photographic element while retaining the associated dye image within the element. After washing and treatment with stabilizer and/or wetting agent, the element is then dried at atmospheric conditions or, more conventionally, in a drying cabinet heated to from about 24° C. to about 70° C.

The method of the present invention is useful in the processing of any silver halide photographic element containing color couplers (including negative and positive photographic films and papers). The method is, of course, most advantageously applied to photographic elements containing color couplers which are susceptible to partial inactivation by formaldehyde or vinyl monomers, i.e., elements containing couplers such as pyrazolones, as previously described herein and in the patents incorporated herein by reference. The method of the invention alleviates such partial inactivation of couplers, so that the dyes formed by reaction of the couplers with oxidized developing agents have spectral absorptivities approaching the levels achieved by using the previously known technique of separate ferricyanide re-bleaching followed by washing.

The following example is provided to further illustrate a preferred embodiment of the method of the invention.

EXAMPLE

Samples of a conventional multilayer color negative photographic film, comprising a blue-light-sensitive gelatin silver halide emulsion layer containing a yellow-dye-forming coupler, a green-light-sensitive gelatin silver halide emulsion layer containing a magenta-dye-forming coupler and a red-light-sensitive gelatin silver halide emulsion layer containing a cyan-dye-forming coupler, were subjected for 66 hours in a closed vessel to the vapor from 10 g. paraformaldehyde. The samples receiving such treatment were compared with untreated samples by exposing all samples to light to create maximum exposure and then processing all samples through conventional baths of developer, bleach, fixer and rinse (the developer comprised a primary aromatic amino color developing agent, and the bleach comprised iron ammonium EDTA, a mild oxidizing agent). The measured density to green light of the resultant untreated film samples was 2.31, while the density of the formaldehyde-treated film samples was only 1.70. When some samples of the treated film were re-bleached in a ferricyanide solution containing 20 gm./liter potassium ferricyanide for 1 minute and then washed with water for 3 minutes, their density increased to 2.00.

Table I shows the results of the tests above and of oxidizing some of the formaldehyde-treated materials with a formalin stabilizing bath to which hydrogen peroxide was added to a concentration of 0.6 percent by weight and to which various small concentrations of oxidation accelerators (namely, potassium ferricyanide, sodium anthraquinone-disulfonate, or disodium iron EDTA) were added. The data in Table I indicate that treatment with hydrogen peroxide plus small amounts of oxidation accelerator results in dye densities approaching those achievable by re-bleaching with ferricyanide. In this respect, the aqueous solution containing 0.6 weight percent hydrogen peroxide and 0.0002 weight percent potassium ferricyanide performed best among those solutions tested.

TABLE I

| Sample Treated With Formaldehyde? | Sample Re-Bleached With 20g/l Ferricyanide? | Sample Treated With Formalin Stabilizer? | % By Weight Of Hydrogen Peroxide in Stabilizer Bath | % By Weight of Potassium Ferricyande In Stabilizer Bath | % By Weight of Sodium Anthraquinonedisulfonate in Stabilizer Bath | % By Weight of Disodium Iron EDTA In Stabilizer Bath | Optical Density of Sample to Green Light |
|---|---|---|---|---|---|---|---|
| No | No | No | — | — | — | — | 2.31 |
| Yes | No | No | — | — | — | — | 1.70 |
| Yes | Yes | No | — | — | — | — | 2.00 |
| Yes | No | Yes | 0.6 | 0 | 0 | 0 | 1.79 |
| Yes | No | Yes | 0.6 | 0.0001 | 0 | 0 | 1.90 |
| Yes | No | Yes | 0.6 | 0.0002 | 0 | 0 | 1.96 |
| Yes | No | Yes | 0.6 | 0.0003 | 0 | 0 | 1.85 |
| Yes | No | Yes | 0.6 | 0 | 0.0001 | 0 | 1.91 |
| Yes | No | Yes | 0.6 | 0 | 0.0002 | 0 | 1.82 |
| Yes | No | Yes | 0.6 | 0 | 0 | 0.0001 | 1.90 |
| Yes | No | Yes | 0.6 | 0 | 0 | 0.0002 | 1.87 |

The invention has been described in detail with reference to particular preferred embodiments thereof, but it will be understood that variations and modifications can be effected within the spirit and scope of the invention.

What is claimed is:

1. A method for alleviating partial inactivation of a color coupler, said partial inactivation having been caused by reaction of the color coupler with formaldehyde or a vinyl monomer, said method comprising contacting the color coupler with an aqueous solution comprising hydrogen peroxide or deuterium peroxide as an oxidizing agent and an oxidation accelerator capable of acting as a potential mediator for transferring electrons between the oxidizing agent and the color coupler.

2. A method for increasing the spectral absorptivity of a dye formed by the reaction of an oxidized primary aromatic amino color developing agent with a color coupler which has been partially inactivated by reaction with formaldehyde or a vinyl monomer, said method comprising contacting said dye with an aqueous solution comprising hydrogen peroxide or deuterium peroxide as an oxidizing agent and an oxidation accelerator capable of acting as a potential mediator for transferring electrons between the oxidizing agent and the coupler portion of the dye.

3. In a method for producing a dye image in an imagewise exposed photographic element comprising a silver halide and a color coupler susceptible to partial inactivation by reaction with formaldehyde or a vinyl monomer, said method comprising the steps of:

(a) contacting said element with a primary aromatic amino color developing agent to produce within the element a silver image and an associated dye image formed by reaction of said color coupler with oxidized color developing agent, and (b) contacting said element with a bleaching agent and a fixing agent either simultaneously or successively in order to remove unexposed silver halide and said silver image from said element while retaining said dye image, the improvement wherein step (b) is followed by:

(c) contacting said element with an aqueous solution comprising hydrogen peroxide or deuterium peroxide as an oxidizing agent and an oxidation accelerator capable of acting as a potential mediator for transferring electrons between the oxidizing agent and the color coupler portion of the dye image in order to alleviate said partial inactivation of said color coupler.

4. The method of claims 1, 2, or 3 wherein said oxidizing agent is hydrogen peroxide.

5. The method of claim 4 wherein said aqueous solution comprises from about 0.3 percent to about 0.6 percent by weight of said hydrogen peroxide.

6. The method of claims 1, 2, or 3 wherein said aqueous solution comprises more than 0 percent and less than 0.001 percent by weight of said oxidation accelerator.

7. The method of claims 1, 2, or 3 wherein said oxidation accelerator is potassium ferricyanide, sodium anthraquinonedisulfonate, or disodium iron ethylenediaminetetraacetic acid.

8. The method of claims 1, 2, or 3 wherein said aqueous solution comprises from about 0.0001 percent to about 0.0003 percent by weight of said oxidation accelerator, and said oxidation accelerator comprises potassium ferricyanide.

9. The method of claims 1, 2, or 3 wherein said aqueous solution comprises formaldehyde.

10. The method of claims 1, 2, or 3 wherein said aqueous solution comprises a wetting agent.

11. The method of claims 1, 2, or 3 wherein said aqueous solution comprises a pH buffer.

12. The method of claim 3 wherein said method comprises drying said photographic element after carrying out the steps described in claim 3.

13. The method of claim 12 wherein said drying is carried out at a temperature of from about 24° C. to about 70° C.

14. The method of claim 3 wherein said bleaching agent is incapable of overcoming partial inactivation of said color coupler caused by reaction of the color coupler with formaldehyde or a vinyl monomer.

15. The method of claim 14 wherein said bleaching agent comprises iron ammonium ethylenediaminetetraacetic acid.

16. The method of claims 1, 2, or 3 wherein said color coupler comprises a pyrazolone.

17. In a method for producing a dye image in an imagewise exposed photographic element comprising a silver halide and a color coupler susceptible to partial inactivation by reaction with formaldehyde or a vinyl monomer, said method comprising the steps of:

(a) contacting said element with a primary aromatic amino color developing agent to produce within the element a silver image and an associated dye image formed by reaction of said color coupler with oxidized color developing agent, and (b) contacting said element with a bleaching agent and a fixing agent either simultaneously or successively in order to remove unexposed silver halide and said silver image from said element while retaining said dye image, the improvement wherein step (b) is followed by:

(c) contacting said element with an aqueous solution comprising from about 0.3 percent to about 0.6 percent by weight of hydrogen peroxide as an oxidizing agent and potassium ferricyanide, sodium anthraquinonedisulfonate, or disodium iron ethylenediaminetetraacetic acid as an oxidation accelerator in order to alleviate said partial inactivation of said color coupler.

* * * * *